US006062711A

United States Patent [19]

Huang

[11] Patent Number: 6,062,711

[45] Date of Patent: May 16, 2000

[54] COUPLING DEVICE FOR CHRISTMAS LIGHT

[76] Inventor: Shun-Feng Huang, No.56, Min Sheng Street, Feng-Yuan City 42041, Taiwan

[21] Appl. No.: 09/336,383

[22] Filed: Jun. 15, 1999

[51] Int. Cl.[7] ..... F21V 21/36

[52] U.S. Cl. ..... 362/391; 362/249; 362/396

[58] Field of Search ..... 362/249, 252, 362/226, 391, 396, 806

[56] References Cited

U.S. PATENT DOCUMENTS 5,908,238 6/1999 Huang ..... 362/391
5,941,628 8/1999 Chang ..... 362/249

*Primary Examiner*—Stephen Husar

[57] ABSTRACT

A coupling device for Christmas light is provided, the coupling device includes a pair of rectangular recesses in the opposing inner peripheries of an electrical socket for respectively securing a pair of contact plates from a pair of electrical wires, a pair of lugs on opposing outer peripheries of the socket each having a cylindrical space and a slit entrance for receiving the wires and a pair reinforcement plate extending outward from opposing peripheries of the socket positioned in front of the slit entrances a pair of L-shaped extensions symmetrically projected outward from the upper rim of a bulb base each having longer portion extending downward engageable with the slit entrances and urge on their backs by the reinforcement plates. Thereby, the electrical wires are blocked up by the L-shaped extensions without breakaway.

4 Claims, 5 Drawing Sheets

COUPLING DEVICE FOR CHRISTMAS LIGHT

BACKGROUND OF THE INVENTION

The present invention relates to the Christmas lights and more particularly to a coupling device for Christmas light which device can firmly connect the bulb with the socket of the Christmas light and reliably attach the wires between the Christmas lights for arrangement of light patterns or alphabet in order to achieve a cosmetic effect.

Typical strung up Christmas light has a coupling device on outer periphery for the attachment of the wires between the light to make a network for presenting a light pattern or alphabet. One of my previous invention as shown in FIG. 1 comprises a socket 1, a pair of lugs 2 symmetrically projected outward from the opposing peripheries of the socket 1, a pair of electrical wires 3 extending out from the bottom of the socket 1. The lug is made of elastic material and each has slit 4 for facilitating the pressed in of the wires 3. A bulb 6 engaged with a base 5 which is eventually pressed in the socket 1.

However, the strung up Christmas light has the following disadvantages such that the electrical wires 3 may disengaged with lugs 2 and/or the bulb so as to cause an electric disconnection.

SUMMARY OF THE PRESENT INVENTION

The present invention has a main object to provide a coupling device for Christmas light which device is reliable so as to prevent the electrical wires from disengagement with the lugs on outer peripheries of the socket.

Another object of the present invention is to provide a coupling device in which a rectangular recess is formed in the opposing inner peripheral walls of the socket made engageable within a rectangular contact plate at the end of each of the electrical wires so that the electrical disconnection between the bulb and the wires will be eliminated which the wires are under external pullings.

Farther object of the present invention is to provide a coupling device in which a reinforcement plate is formed adjacent each of the lugs to prevent the disengagement of the wire from the lugs.

The present invention will become more fully understood by reference to the following detailed description thereof when read in conjunction with the attached drawings.

DETAILED DESCRIPTION OF THE PREFERRED EMBODIMENT

Figure 1:
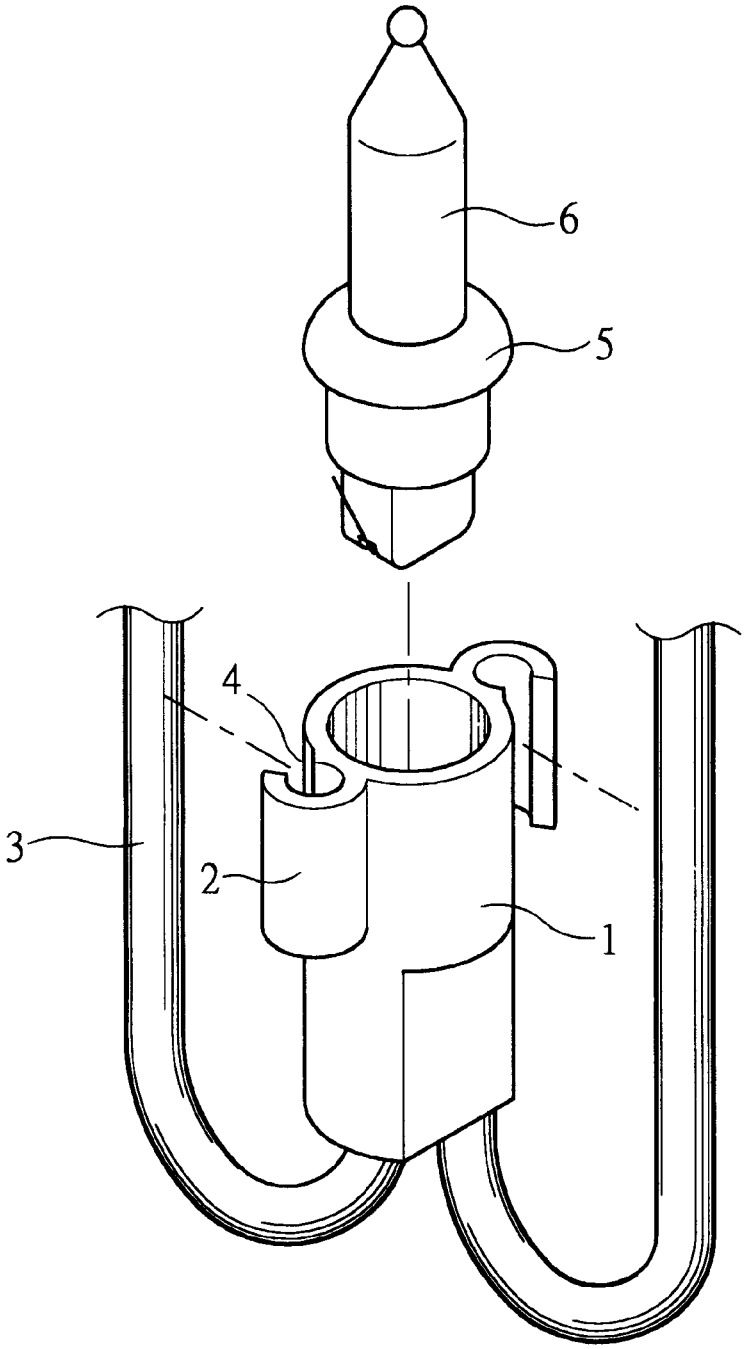
FIG.1 Prior Art
FIG. 1 is an exploded perspective view of a strung up Christmas light of a prior art.
Figure 2:
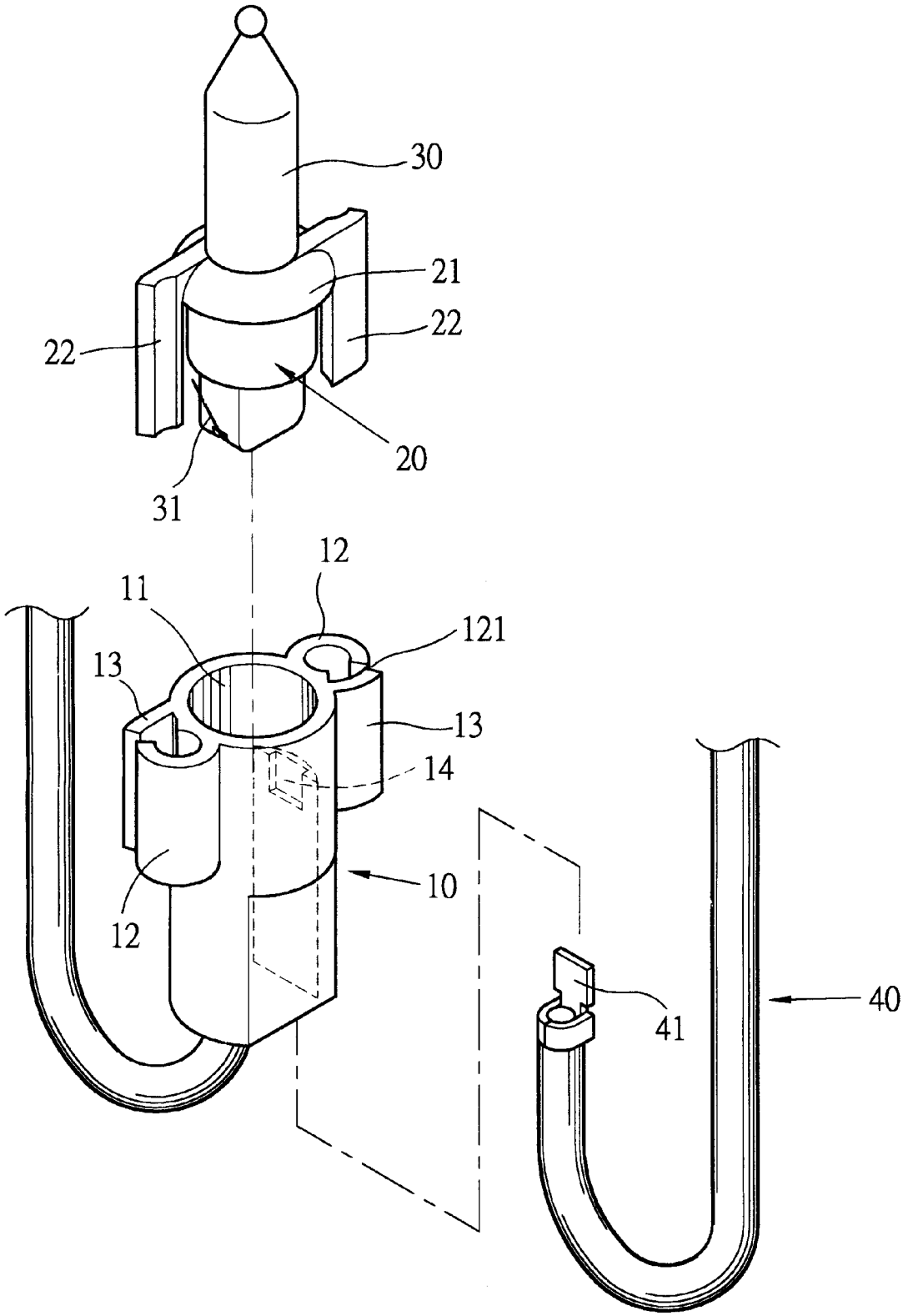
FIG. 2 is an exploded perspective view to show a preferred embodiment of the present invention.
Figure 3:
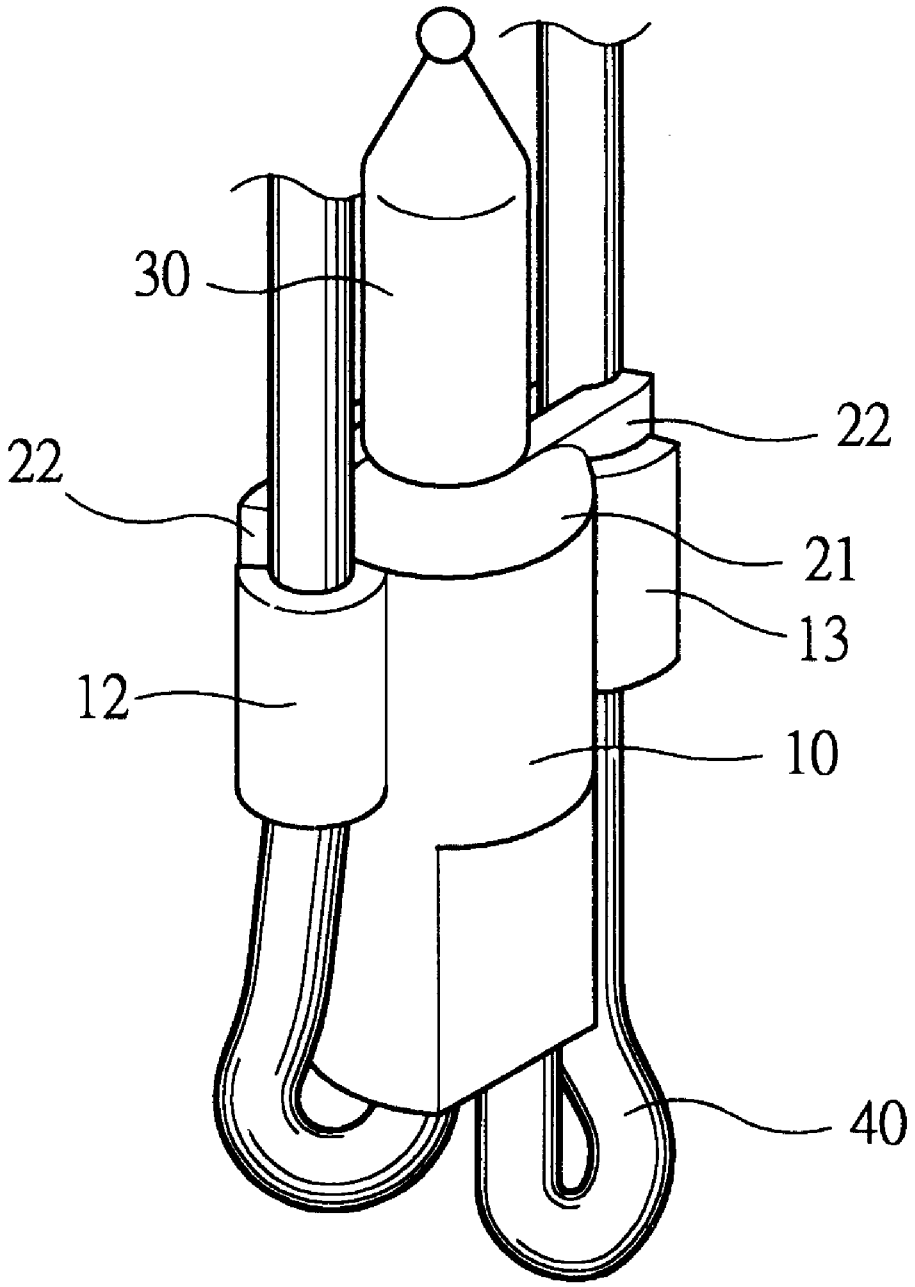
FIG. 3 is a perspective view showing the assemblage of FIG. 2.
Figure 4:
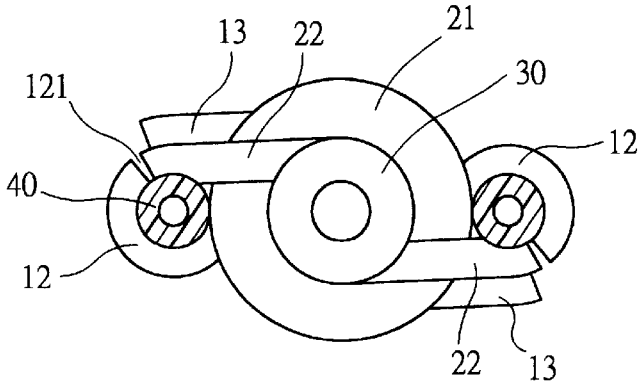
FIG. 4 is a sectional view of FIG. 3.

With reference to FIGS. 2 to 4 of the drawings, the coupling device for Christmas light of the present invention comprises generally an electrical socket 10, a base 20 into which a bulb 30 is axially secured and a pair of lead-in wires 31 extending as out of the bottom of the base 20 and attached to each of the lateral sides of the base 20. The socket 10 includes a pair of lugs 12 symmetrically and alternately extending outward from the opposing outer peripheries of the socket 10, an upper opening 11 and a pair of rectangular recesses 13 symmetrically formed in the opposing inner peripheral walls into each of which a rectangular contact plate 41 at an end of a pair of electrical wires 40 is secured. The lugs 12 are made of elastic arcuate plate and each has a slit entrance 121 for facilitating one of the electrical wires 40 pressed into a cylindrical space defined by the plate and a reinforcement plate 13 which is extending outward from the outer peripheral walls of the socket 10 in front of the slit entrances 121 of the lugs 12 and has the length equal to that of the slit entrances 121.

A pair of L-shaped extensions 22 symmetrically extending outward from the opposing rims 21 of the base 20 each of which includes a longer portion extending downward.

When assembling first engage the rectangular contact plates 41 of the pair of electrical wires 40 into the rectangular recesses 13 of the socket 10 respectively and engage the wires 40 into the respective lugs 12 in a snap fitting and then axially press the base 20 in place into the socket 10 via the opening 11 so that the lead-in wires 31 are automatically engaged with the contact plates 41 and prevented the plate 41 from disengagement with the recesses 13. Meanwhile, the longer portions of the L-shaped extensions 22 slidably engage with the slit entrances 121 of the lugs 12 in the manner that the L-shaped extensions 22 are resisted between the electrical wires 40 and the reinforcement plates 13 so that the slit entrances 121 are completely block up by the extensions 22 and the electrical wires 40 will not be breakaway from the lugs 12.

Figure 5:
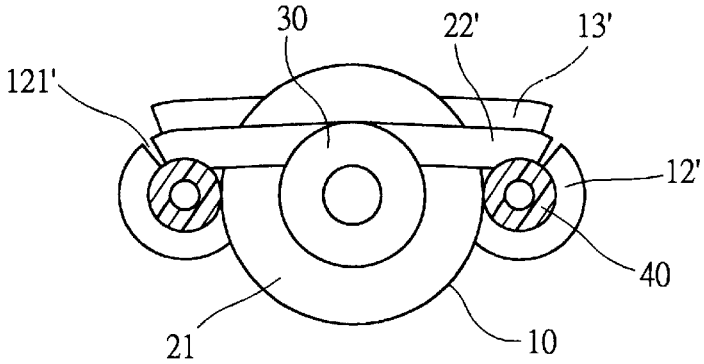
FIG. 5 is sectional view to show an alternative embodiment of the present invention.

Referring to FIG. 5, an alternative embodiment is provided in which the structure and function are mostly similar to the previous embodiment as shown in FIGS. 2 to 4, the above discussion are acceptable in the most instances. The only differences are that the lugs 12 are no longer alternate so as to redesignate as 12' and their slit entrances become toward one direction now so as redesignated as 121'. Meanwhile the reinforcement plates 13 are no longer alternate also but direct to each other so as to redesignated as 13'. To consist with the above changes, the L-shaped extensions 22 of the base 20 are moved to one side of the base 20 and redesignated as 22'. Upon this slight modification, the L-shaped extensions 22' can also block up the slit entrances 121' of the lugs 12'.

Figure 6:
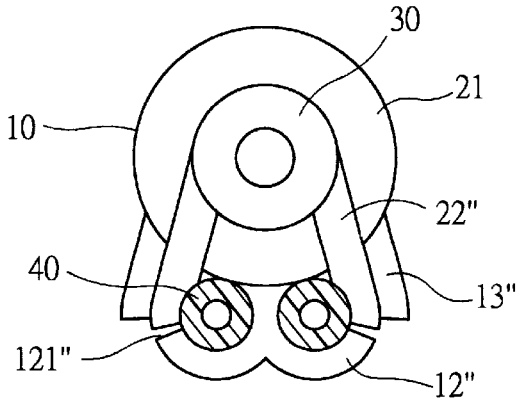
FIG. 6 is a sectional view of to show another alternative embodiment of the present invention.

Referring to FIG. 6 of a sectional view showing another alternative embodiment of the present invention in which the most structure and function are unchanged, too. The only modification is made to the coupling device is that in comparison with the embodiments shown in FIGS. 2 to 5, the pair of lugs 12 become a single projection 12" projected outward from an outer periphery of the electrical socket 10 including a pair of arcuate branches 141 extending laterally relative to the center of the projection 12" so as to define a pair of cylindrical spaces for respectively receiving the pair of electrical wires 40 and a pair slit entrances 121". Whereas, the pair of the L-shaped extensions 22 are moved to same side of the base 20 respectively directing to the slit entrances 121" and re-designated as 22". Meanwhile the reinforcement plates 13 are moved to one side of the socket 10 and enable to respectively reinforce the outer sides of the extensions 22" so as to redesignated as 13". Upon the changing of position, the extensions 22" can also effectively block up the slit entrance 121" of the single projection 12".

Figure 7:
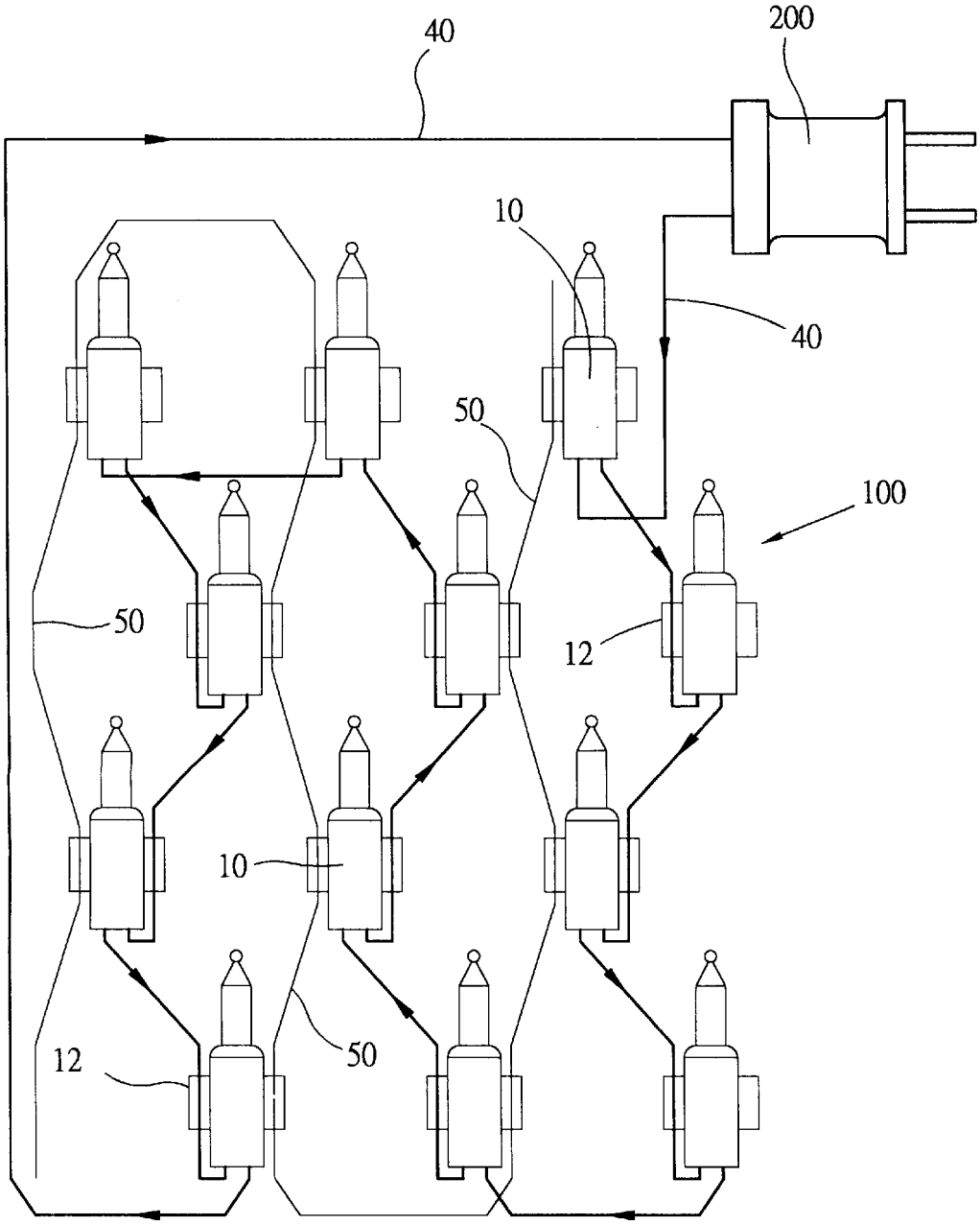
FIG. 7 is a plane view of indicating an arrangement of the Christmas lights of the present invention into a network.

Referring to FIG. 7, which illustrates that coupling device of the Christmas light of the present invention is enable to be combined a network 100 of patterns or alphabet. The network 100 includes a plurality of the Christmas lights 10 combined in string by a cord 50 which secures into one of the lugs 12 of each of the lights and an electrical wires 40 which comes from a plug 200 and sequentially connects each of the light 10 and then secures to another lug 12 of the lights and finally returns to the plug 200. When the plug 200 connects to a electrical power source, a circulation of the electrical current is therefore accomplished to light all the Christmas light 10 in the network 100.

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A coupling device for Christmas light comprising:

an electrical socket including a first opening in top, a pair of rectangular recesses symmetrically formed in opposing inner peripheries for respectively securing in a pair of rectangular contact plates from a free end of each of a pair of electrical wires and a pair of lug members of arcuate elastic plate symmetrically and alternately extending outward from opposing outer peripheries thereof and each having a cylindrical receiving space for respectively receiving said pair of electrical wires, a slit entrance communicating with the receiving space and a pair of reinforcement plates symmetrically and alternately extending outward from opposing outer peripheries thereof in front of said slit entrances;

a base including a second opening and a rim on top, a bottom, a bulb axially disposed into the second opening having a pair of lead-in wires extending out of the bottom and respectively attached to opposing lateral sides of the bottom and a pair of L-shaped extensions symmetrically and alternately extending outward from the rim thereof each having a longer portion extending downward and engageable with the slit entrances of said lug members and a urged by the pair of reinforcement plates on back side thereof;

when said base axially secures into the first opening of said electrical socket, said lead-in wires will contact with said rectangular contacts plate and the longer portions of said L-shaped extensions will block up the slit entrances of said lug members.

2. A coupling device for Christmas light comprising:

an electrical socket including an opening in top, a pair of rectangular recesses symmetrically formed in opposing inner peripheries for respectively securing a pair of rectangular contact plates from a free end of each of a pair of electrical wires, a pair of lug members extending outward from opposing peripheries of the socket each having a cylindrical receiving space for respectively receiving a pair of electrical wires and a slit entrance toward some direction and a pair of reinforcement plates extending laterally from one side of said socket directing to each other and each having a free end closing to the slit extremes of said lug members;

a base including a bulb, an upper rim, a bottom engageable into the opening of said socket, a pair of lead-in wires extending out of the bottom and attached to respective lateral side of the bottom and a pair of L-shaped extensions extending laterally from one side of the rim directing to each other and having their free ends respectively engaging with the slit entrances of said lugs and urged on their backs by the reinforcement plates respectively.

3. A coupling device for Christmas light comprising:

an electrical socket including an opening in top, a pair of rectangular recesses symmetrically formed in opposing inner peripheries for respectively securing in a pair of rectangular contact plates from a free end of each of a pair of electrical wires, a single lug member extending outward from an outer periphery thereof having a pair of arcutate branches symmetrically extending outward to define a pair of cylindrical receiving spaces for respectively receiving the pair of electrical wires therein and each having a slit entrance and a pair of reinforcement plates extending outward from one side of said socket having their free ends respectively closing to the slit entrances of the lug member;

a base including a bulb, an upper rim, a bottom engageable into the opening of said socket, a pair of lead-in wires extending out of the bottom and attached to respective lateral side of the bottom and a pair of L-shaped extensions parallel extending spaced apart from said rim engageable into the slit entrances of said lug member respectively and urged on their back sides by the reinforcement plate.

4. The coupling device according to any of the preceding claims wherein said Christmas light is combinable into a network.

* * * * *